US006530853B1

(12) United States Patent
Giannetti

(10) Patent No.: US 6,530,853 B1
(45) Date of Patent: Mar. 11, 2003

(54) ARROWHEAD ASSEMBLY

(75) Inventor: Nickolas Giannetti, Pleasant Mt, PA (US)

(73) Assignee: Ballistic Archery, Inc., Stockton, NJ (US)

( * ) Notice: Subject to any disclaimer, the term of this patent is extended or adjusted under 35 U.S.C. 154(b) by 0 days.

(21) Appl. No.: 09/985,280

(22) Filed: Nov. 2, 2001

(51) Int. Cl.[7] ..... F42B 6/08
(52) U.S. Cl. ..... 473/584
(58) Field of Search ..... 473/583, 584

(56) References Cited

U.S. PATENT DOCUMENTS

| | | | | |
|---|---|---|---|---|
| D236,465 | S | | 8/1975 | Hamilton |
| 4,928,969 | A | | 5/1990 | Nagatori |
| 4,974,859 | A | * | 12/1990 | Briesemeister |
| 5,044,640 | A | * | 9/1991 | Delmonte et al. |
| D326,889 | S | | 6/1992 | Garoutte |
| 5,137,282 | A | | 8/1992 | Segar et al. |
| 5,145,186 | A | | 9/1992 | Maleski |
| 5,165,697 | A | | 11/1992 | Lauriski et al. |
| 5,354,068 | A | | 10/1994 | Maleski |
| 5,417,440 | A | | 5/1995 | Barrie et al. |
| 5,494,298 | A | | 2/1996 | Maleski |
| D385,327 | S | | 10/1997 | Delmonte |
| 5,803,844 | A | | 9/1998 | Anderson ..... 473/583 |
| 5,871,410 | A | | 2/1999 | Simo et al. ..... 473/583 |
| 6,015,357 | A | | 1/2000 | Rizza ..... 473/583 |
| 6,045,468 | A | * | 4/2000 | Tinsley et al. ..... 473/584 |
| 6,077,180 | A | * | 6/2000 | Adams et al. ..... 473/584 |

FOREIGN PATENT DOCUMENTS

| | | |
|---|---|---|
| CA | 2020321 | 7/1991 |
| CA | 2075522 | 2/1993 |
| CA | 2084141 | 7/1994 |
| FR | 2592709 | 7/1987 |

* cited by examiner

*Primary Examiner*—John A. Ricci
(74) *Attorney, Agent, or Firm*—Richard C. Litman

(57) ABSTRACT

An arrowhead assembly provides for removable installation of one or more flat, planar, laterally symmetrical knife blade type arrowhead blades to an arrowhead body. The arrowhead body includes a series of slots in its leading end, and a slotted ring formed rearwardly of the leading end. The blades each include an open central area and a pair of opposed tangs extending outwardly and rearwardly from their trailing edges. A lock washer includes a series of inwardly disposed tang clearance slots and catches, for securing the blades to the arrowhead body. The blades are assembled on the body with the tangs extending rearwardly of the retaining ring, with the washer placed over the tangs and turned fractionally to place the catches between the retaining ring and tangs, thereby holding the blades in place on the body. The present assembly precludes requirement for tedious threading of components.

18 Claims, 7 Drawing Sheets

ARROWHEAD ASSEMBLY

BACKGROUND OF THE INVENTION

1. Field of the Invention

The present invention relates generally to the sport of archery, and more specifically to an assembly for securing bladed arrowheads to an arrow shaft ferrule. The present assembly utilizes an internally slotted washer which fits over complementary extensions at the bases of the blades, to lock the blades in place on the body with a fraction of a turn of the washer. The present assembly is adaptable to virtually any blade configuration having a flat, thin configuration, for single or any practicable number of plural blades.

2. Description of the Related Art

The sport of archery has developed tremendously since its origins as a necessary activity in primitive times. Yet, it still remains a challenging sport, with the hunter or archer dependent only upon his or her own strength and skill to hit the target precisely or to produce a clean kill of a game animal. Archers are of course constantly searching for the most advanced technology possible, in order to provide greater accuracy, stopping or killing power when hunting, ease of maintenance, and other factors.

As the sport has evolved, relatively thin arrowhead blades have become common, particularly for hunting. Such thin blades provide superior penetration and killing power when hunting, but their drawback is their relative fragility. Such thin arrowhead blades are easily bent or broken if they strike bone, or perhaps a stone or other hard object if the shot is missed or penetrates completely through the target. As a result, it has become standard procedure to provide for the replacement of blade elements as required on the arrow shaft attachment body, rather than forcing the archer to outlay a considerable expense to replace the entire assembly or perhaps the entire arrow, when all components excepting perhaps a single blade edge are in perfect condition. Such replaceable blade elements are also more easily sharpened than blades which are inseparably affixed to the shaft attachment body, or to the leading end of the arrow shaft itself.

A number of means of providing such replaceable blades on a blade attachment body, have been developed in the past. These replaceable arrowhead and/or blade assemblies almost universally rely upon a threaded mechanism for holding the blades in place on the body or leading end of the arrowhead shaft. Most such threaded assemblies rely upon the clamping action of a tapered collet arrangement to hold the blades in place, rather than providing positive retention. Those that do provide positive retention, require some significant time to thread and unthread the retaining components through several turns, as the threads are engaged and disengaged.

Accordingly, a need will be seen for an arrowhead assembly for retaining thin arrowhead blades upon a body, which in turn is secured to the leading end of an arrow shaft. The present invention provides positive and accurate retention and alignment of the blades relative to the body, while also providing for ease of release and locking in place through a fractional turn of a locking retaining washer. The present system provides numerous benefits in the field, particularly in savings of time and effort during arrowhead blade removal and replacement.

A discussion of the related art of which the present inventor is aware, and its differences and distinctions from the present invention, is provided below.

U.S. Pat. No. 4,928,969 issued on May 29, 1990 to Wesley S. Nagatori, titled "Arrowhead," describes an assembly in which two flat blades are assembled together in a cruciform configuration. The primary blade includes a rearward extension, with threads cut or formed along the edges of the flat extension. A cruciform slotted body receives the two blades, with the blade and body assembly then securing to the end of the arrow shaft by means of the threaded edges of the rearward extension of the primary blade engaging cooperating internal threads in the leading end of the arrow shaft. In contrast, the present invention does not utilize any threaded means for securing the arrowhead components to the leading end of the arrow shaft, but rather utilizes a slotted body and complementary internally slotted lock washer to secure the trailing ends of the blades to the body.

U.S. Pat. No. 5,137,282 issued on Aug. 11, 1992 to Donald E. Segar et al., titled "Plastic Molded Arrowhead And Method," describes an assembly formed of two mutually orthogonal flat metal blades which are placed in a mold and combined with plastic material about portions thereof. The plastic forms a rearward extension for securing the assembly to the leading end of the arrow shaft, and also covers the inner edges of the open blades, leaving the outer metal cutting edges exposed. The problem with the Segar et al. assembly is that the blades cannot be disassembled from one another for replacement of a single blade element, without destroying the plastic matrix which secures them together. The Segar et al. assembly thus cannot be repaired in the field by disassembly to sharpen individual blade elements, or to replace a single blade element, as can the present blade assembly.

U.S. Pat. No. 5,145,186 issued on Sep. 8, 1992 to Richard Maleski, titled "Broadhead For An Arrow And Method Of Securement," describes an assembly having a series of laterally asymmetrical blade elements each having a body attachment edge and an outward cutting edge. The Maleski blade elements do not extend symmetrically across the body, as do the present blade elements, but rather abut the side of the body. They are captured on the body by a separate tip component which threads onto the body and captures the forward tips of the blade elements, and a similar collet which threads onto the rearward end of the body. The present assembly needs no additional tip component to secure the blade elements, nor any threaded components.

U.S. Pat. No. 5,165,697 issued on Nov. 24, 1992 to Stanley E. Lauriski et al., titled "Broadhead Archery Hunting Point," describes an assembly having a relatively complex body assembly formed of two different metals in three different portions, which are press fit together. The blade elements assemble to the body assembly through slots in the body and mating reliefs in the blades. However, the Lauriski et al. blades are secured only when the body assembly is threaded into the socket at the leading end of the arrow shaft. In contrast, the present assembly locks the blades to the body by means of a specially formed washer which secures to the trailing end of the body, separate from the arrow shaft.

U.S. Pat. No. 5,354,068 issued on Oct. 11, 1994 to Richard Maleski, titled "Broadhead For An Arrow And Method Of Securement," is a continuation in part of the '186 parent U.S. Patent, discussed further above. The assembly of the '068 U.S. Patent utilizes a longer tapered collet at the trailing end of the body, in comparison to the assembly of the '186 parent U.S. Patent. However, both differ considerably from the present arrowhead assembly, in that both of the Maleski assemblies utilize laterally asymmetrical blade components with inboard edges which abut the side of the body, rather than symmetrical blade elements which pass through slots formed through the body, as in the present arrowhead assembly.

U.S. Pat. No. 5,417,440 issued on May 23, 1995 to Robert Barrie et al., titled "Broadhead Arrow Tip," describes an assembly much like that of the '186 and '068 Maleski U.S. Patents discussed further above. The Barrie et al. assembly also uses laterally asymmetrical blade components which abut the sides of the arrowhead body and are secured at their forward and trailing ends by separate components which attach to the body. Barrie et al. also disclose a locking collar, which is installed between the arrow shaft insert or ferrule and the trailing end of the arrowhead body. However, the Barrie et al. locking collar has no provision for positively engaging any portions or extensions of the blades, for holding the blades positively in place on the arrowhead body, as provided by the present arrowhead body, blades, and lock washer assembly.

U.S. Pat. No. 5,494,298 issued on Feb. 27, 1996 to Richard Maleski, titled "Broadhead For An Arrow And Method Of Securement," is a third generation continuation in part patent of the '186 U.S. Patent discussed further above. The basic configuration is the same as that of the assemblies of the '186 and '068 U.S. Patents to the same inventor, both discussed further above, with Maleski using a series of laterally asymmetrical blades with their inboard edges abutting the sides of the arrowhead body. The assembly of the '298 Maleski U.S. Patent includes a tapered collet assembly for locking the trailing end of the arrowhead body to the leading end of the arrow shaft. No partial turn lock washer for securing the blades to a single piece arrowhead body is disclosed in the '298 Maleski U.S. Patent.

U.S. Pat. No. 5,803,844 issued on Sep. 8, 1998 to Jeffrey J. Anderson, titled "Ring Actuated Arrowhead," describes an assembly having a series of laterally pivoting blade components, each secured in a forward position for flight by a retaining ring around their bases and around the base of the arrowhead body. When the Anderson arrowhead hits a target, the retaining ring is forced rearwardly, allowing the blades to pivot open to inflict greater internal damage to an animal target to increase the chances for a kill. Accordingly, the Anderson assembly teaches away from the present invention, with its laterally symmetrical blade components which extend completely across the arrowhead body to each side thereof, and are immovably affixed to the arrowhead body. Moreover, Anderson does not disclose any form of lock washer to immovably affix the trailing ends of the blades to the arrowhead body, as provided by the present arrowhead assembly invention.

U.S. Pat. No. 5,871,410 issued on Feb. 16, 1999 to Miroslav A. Simo et al., titled "Ferrule With Irregular Skin Surface For An Archery Broadhead," describes an arrowhead body having a series of radially disposed slots therein, for holding a corresponding series of laterally asymmetrical blade elements extending therefrom. The primary point of the Simo et al. U.S. Patent is the provision of surface roughness on the exposed portions of the arrowhead body for enhancing flight characteristics of the assembly, apparently in the manner of the dimpled surface of a golf ball. In any event, Simo et al. do not disclose any specific means of securing the blades to the arrowhead body.

U.S. Pat. No. 6,015,357 issued on Jan. 18, 2000 to Joseph D. Rizza, titled "Broadhead For Use As Both An Expandable Blade Head And A Fixed Blade Head," describes an arrowhead assembly having a series of laterally asymmetric blades pivotally secured to the arrowhead body at their trailing ends. A forward arrowhead tip retainer is selectively adjustable to hold the forward tips of the blades in place upon target penetration, or to allow the blades to pivot outwardly and rearwardly for greater damage, as desired. Rizza does not appear to provide any means for replacement of his blades on his arrowhead body, however, and teaches away from the lock washer mechanism used by the present invention to affix the laterally symmetrical blade elements immovably in place on the arrowhead body and yet still allow their removal as desired.

U.S. Pat. No. D-236,465 issued on Aug. 26, 1975 to Wilton Hamilton, titled "Metal Arrowhead," illustrates a design having a major flat, planar blade element and a minor element orthogonally positioned relative to the major element. The two elements are laterally symmetrical, and extend across the arrowhead body. The entire assembly appears to be a single, integrated, monolithic unit, with no means for disassembling the blades from the body.

U.S. Pat. No. D-326,889 issued on Jun. 9, 1992 to Larry W. Garoutte, titled "Arrow Broadhead," illustrates two embodiments of a design essentially comprising three radially extending major blades with a smaller frontally positioned minor flat blade. No means is apparent for disassembling the device, nor is there any provision for laterally symmetrical major blade elements.

U.S. Pat. No. D-385,327 issued on Oct. 21, 1997 to Nicholas J. Delmonte, titled "Cutting Ferrule Broadhead," illustrates a design comprising two embodiments, with the embodiments having either two or three major blades extending radially therefrom with a series of smaller blades evenly spaced therebetween. As in the arrowheads of the other U.S. Design Patents discussed further above, no means for disassembling the Delmonte arrowhead is apparent.

French Patent Publication No. 2,592,709 published on Jul. 10, 1987 to Jean-Marie Coche et al. describes (according to the English abstract and drawings) a bladeless, bullet-shaped target arrowhead or tip. The arrowhead of the '709 French Patent Publication teaches away from the present invention, as no blades are provided. According to the English abstract, this is desirable, in order to avoid the damage that frequently occurs to arrowhead blades.

Canadian Patent Publication No. 2,020,321 published on Jul. 4, 1991 to Riley Puckett, titled "Broadhead Hunting Arrow," describes an arrowhead having a series of pivotally attached blades. The blades are held in a folded position until the tip of the arrowhead impacts the target, whereupon the tip is driven rearwardly to extend the blades. The Puckett arrowhead assembly is thus more closely related to the folding arrowheads of the Anderson '844 and Rizza '357 U.S. Patents than to the present arrowhead assembly, with its immovably affixed, laterally symmetrical blade components which extend across the arrowhead body.

Canadian Patent Publication No. 2,075,522 published on Aug. 7, 1992 to Doug Massey, titled "Expandable Broadhead For An Arrow," describes another arrowhead having pivotally installed blades, for spreading after entering a target. The Massey blades are retained by a magnetic slug within the hollow body of the arrowhead, with target impact jarring the slug forwardly to release the pivotally mounted blades. No means is provided for removing the laterally asymmetrical blades from their attachments to the arrowhead body, in the Massey arrowhead. The Massey arrowhead thus more closely resembles the arrowheads disclosed in the Anderson '844 and Rizza '357 U.S. Patents and the Puckett '321 Canadian Patent Publication, each of which is discussed further above, than it does the present arrowhead assembly.

Finally, Canadian Patent Publication No. 2,084,141 published on Jul. 4, 1993 to Riley Puckett, titled "Broadhead With Improved Flight Characteristics And Pivotable Blades," describes an arrowhead assembly having pivotally mounted blades therein. The assembly of the Puckett '141 Canadian Patent Publication is more closely related to the pivoting arrowhead blades of the Anderson '844 and Rizza '357 U.S. Patents and the Puckett '321 and Massey '522 Canadian Patent Publications, than to the present invention with its immovably affixed, laterally symmetrical blade elements.

None of the above inventions and patents, taken either singularly or in combination, is seen to describe the instant invention as claimed. Thus an arrowhead assembly solving the aforementioned problems is desired.

SUMMARY OF THE INVENTION

The present invention is an arrowhead assembly for a plurality of relatively thin, flat arrowhead blades. The present arrowhead assembly includes a novel means for securing the blades to the arrowhead body, precluding requirement for time consuming and tedious threading and unthreading of components to release and secure the blades. The present arrowhead assembly comprises a central arrowhead body having a slotted forward tip and a slotted circumferential blade retaining ring. One or more blades having open centers can be assembled to the arrowhead body, depending upon the number of slots provided in the body. Each blade has an outwardly extending tang at its trailing end, with the tangs protruding rearwardly beyond the retaining ring when the blades are assembled on the arrowhead body.

A lock washer includes a series of inwardly disposed slots for clearing the blade tangs, as well as inwardly disposed catches which pass beneath the tangs to hold the blades in place on the body. The washer need only be turned a fraction of a turn to release the blades to the body, to turn the catches from beneath the tangs and align the slots with the tangs. Locking the blades in place is just as easily accomplished by reversing the fractional rotation. While a single blade element may be used in an embodiment of the present assembly having multiple slots for multiple blades, additional blades may be assembled to the arrowhead body, depending upon the number of blade slots provided in the body and the configuration of the lock washer.

Accordingly, it is a principal object of the invention to provide an arrowhead assembly including means for the removable attachment of one or more flat, planar, laterally symmetrical arrowhead blades thereto.

It is another object of the invention to provide such an arrowhead assembly having an arrowhead body with a slotted leading end and a slotted ring disposed rearwardly of the leading end, for removably fitting and holding one or more arrowhead blades therein.

It is a further object of the invention to provide each blade element with a pair of opposed, outwardly projecting tangs at its trailing end, which tangs project rearwardly from the retaining ring of the arrowhead body when the blades are installed thereon.

Still another object of the invention is to provide a lock washer having a series of tang clearance slots and corresponding series of catches, which washer may be turned fractionally to lock the catches beneath the blade tangs to secure the blades to the body, or reversed to align the clearance slots with the blade tangs for release of the blades.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an arrowhead assembly for removable installation of one or more flat, planar, knife blade type arrowhead blades on an arrowhead body. The present invention utilizes a lock washer to retain the blades on the body, with the washer requiring only a fractional turn (i. e., considerably less than one complete rotation, with the precise arcuate rotation depending upon the specific configuration) to secure or release the arrowhead blades on or from the arrowhead body.

Figure 1:
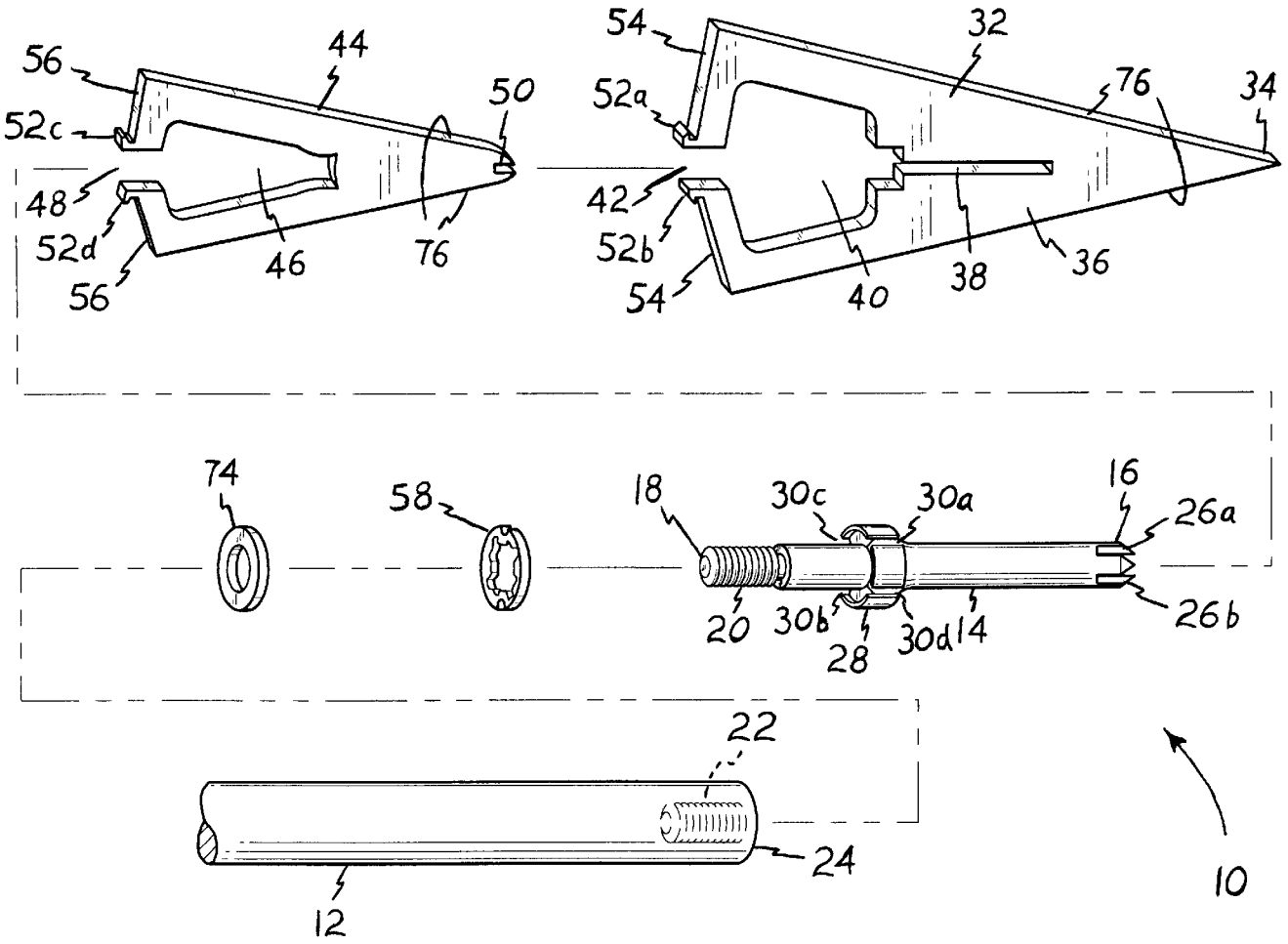
FIG. 1 is an exploded perspective view of an arrowhead assembly according to the present invention, showing its various components.

FIG. 1 of the drawings provides an illustration of the basic components of the present arrowhead assembly 10, along with an arrow shaft 12 which in combination with the arrowhead assembly, form an arrow using the present arrowhead assembly 10. A central, elongate arrowhead body 14 has a leading end 16, with a trailing end 18 opposite the leading end 16. The trailing end 18 includes an externally threaded portion 20, for removably threading into the internal threads 22 formed in the leading end 24 of the arrow shaft 12, as is conventional in the art. The opposite leading end 16 of the arrowhead body 14 includes at least one diametric arrowhead retaining slot formed there across, with the number of slots, e. g. slots 26*a* and 26*b* of the arrowhead body 14 shown in FIG. 1, corresponding to the number of arrowhead blades to be used with the assembly. If only a single blade is to be used, then only a single slot is required. If two blades are to be used, as shown in FIGS. 1 through 6, then two slots must be provided, with the slots crossing one another to hold the blades in the corresponding planes.

The arrowhead body 14 also includes an arrowhead retaining ring 28 circumferentially and concentrically surrounding the body, between the leading end 16 and the trailing end 20. The arrowhead retaining ring 28 secures the trailing edges or ends of the arrowhead blades to the body, as described further below. The position of the retaining ring 28 along the body will depend upon the length of the body and the length of the arrowhead blades used therewith, but the ring 28 will always be between the slot(s) of the leading end 16 and the threaded portion 20 of the trailing end 18 of the body 14. A series of radially disposed arrowhead retaining slots are formed in the ring 28, extending from its outer periphery inwardly to the side or diameter of the body 14 itself. The number of slots provided will depend upon the number of blades to be used in the assembly. Generally speaking, the number of retaining slots in the ring 28 is twice the number of arrowhead blades used in the assembly. In the example of FIGS. 1 through 6, a series of four radial blade retaining slots 30*a* through 30*d* is provided, corresponding to the two arrowhead blades of the assembly. However, it will be seen that additional slots may be provided, e. g., six slots for three blades, eight slots for four blades, etc., as desired, with slots of the leading end of the arrowhead body being provided accordingly. In fact, only two diametrically opposed slots are required in the retaining ring 28, even with multiple blades, if the secondary blades are configured so as not to engage the slots. This is explained below, in the discussion of the arrowhead blades.

The present arrowhead assembly 10 includes at least one primary arrowhead blade 32, and may further include one or more secondary arrowhead blades as well. The primary and secondary blades all comprise flat, planar, laterally symmetrical knife-type blades preferably formed of corrosion resistant metal ("stainless" steel or titanium), for strength and durability. The primary arrowhead blade 32 includes a pointed, sharpened forward tip 34, with a generally solid forward portion 36 immediately behind the tip 34. The solid portion 36 includes an axially aligned slot 38 therein, for engaging one or more secondary blades as described further below. An open central portion 40 and open trailing end 42 provide clearance for the assembly of the primary blade 32 onto the arrowhead body 14.

The secondary blade 44 is configured much like the primary blade 32, having an open center section 46 and open trailing end 48 to fit over the arrowhead body 14. However, the forward tip of the secondary blade 44 includes a longitudinal slot 50 therein, which engages the rearwardly oriented longitudinal slot 38 of the primary blade 32. The two blades form a cruciform cross section when assembled together, as shown by the trailing end portions of the two blades 32 and 44 in FIGS. 2 through 6 of the drawings. As noted above, it will be understood that additional secondary blades may be assembled with the single primary blade if so desired, if the arrowhead body 14 is configured with the appropriate number of diametric slots in the forward end 16 thereof. An example of such is illustrated in FIG. 7, and discussed further below.

At least the primary arrowhead blade 32 includes a pair of opposed locking tangs or tabs, respectively 52*a* and 52*b*, extending rearwardly and outwardly from the solid trailing end portions 54 of the blade 32. The trailing portion of the secondary blade 44 may be formed identically, with a pair of locking tangs 52*c* and 52*d* extending rearwardly and outwardly from the trailing end portions 56 thereof. However, at least one embodiment of the present arrowhead may be configured with the secondary arrowhead blade(s) lacking these tabs or tangs, depending upon the configuration of the locking means used to hold the trailing ends of the blades in place on the arrowhead body. The locking tabs or tangs 52*a* through 52*d* extend rearwardly beyond the retaining ring 28, and are aligned with the corresponding retaining ring slots 30*a* through 30*d* when the blades 32 and 44 are assembled on the arrowhead body 14.

A lock washer or locking collar 58 is removably installed over the trailing end 18 of the arrowhead body 14, adjacent the rearward side or face of the arrowhead blade retaining ring 28. The washer 58 includes a series of slots and catches formed internally therein, and releasibly captures the outwardly extending tangs 52*a* through 52*d* of the arrowhead blades 32 and 34 on the catches to prevent forward movement of the blades 32 and 34 relative to the arrowhead body 14. While the washer 58 embodiment illustrated in FIGS. 1 through 6 shows a series of inward slots and catches equal in number to the tangs of the arrowhead blades, it will be seen that only two opposed slots and catches are required, if the tangs of the secondary blade(s) are eliminated.

Figure 4:
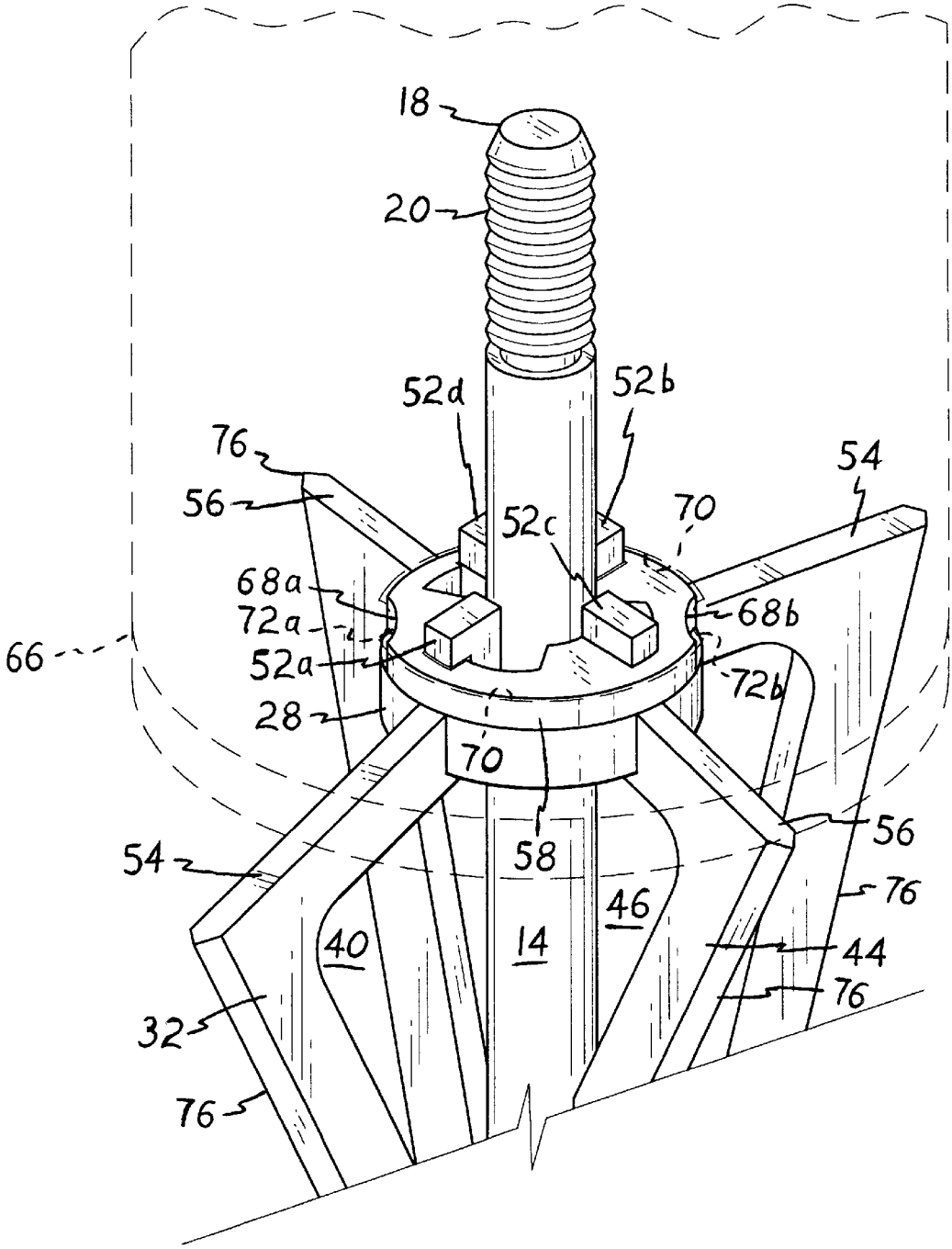
FIG. 4 is an enlarged, broken away perspective view essentially as shown in FIGS. 2 and 3, but showing the fractional rotation of the lock washer by the washer tool.
Figure 5:
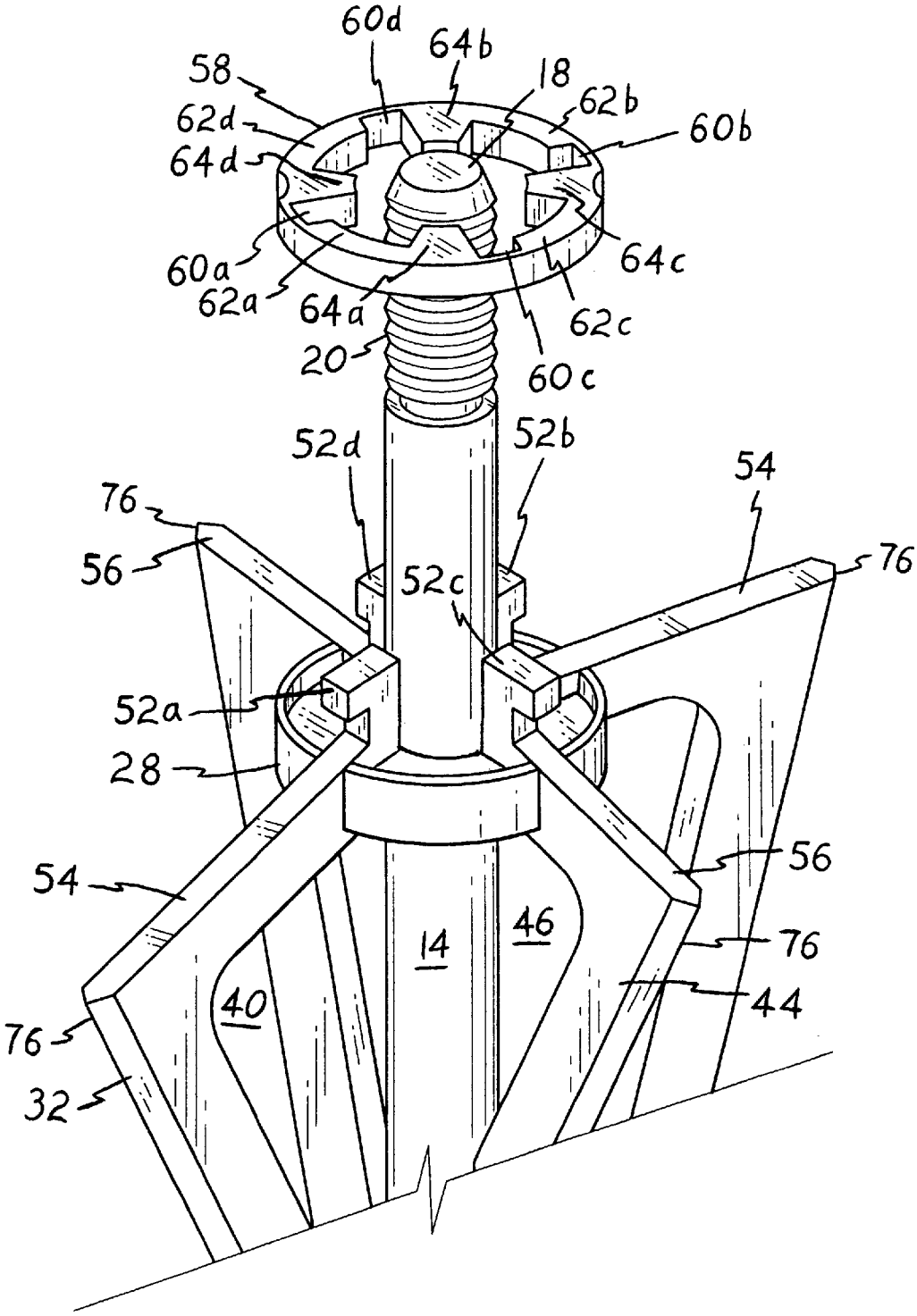
FIG. 5 is an enlarged, broken away perspective view similar to the views of FIGS. 2 through 4, but showing the removal of the lock washer from the arrowhead body and trailing ends of the blades.
Figure 6:
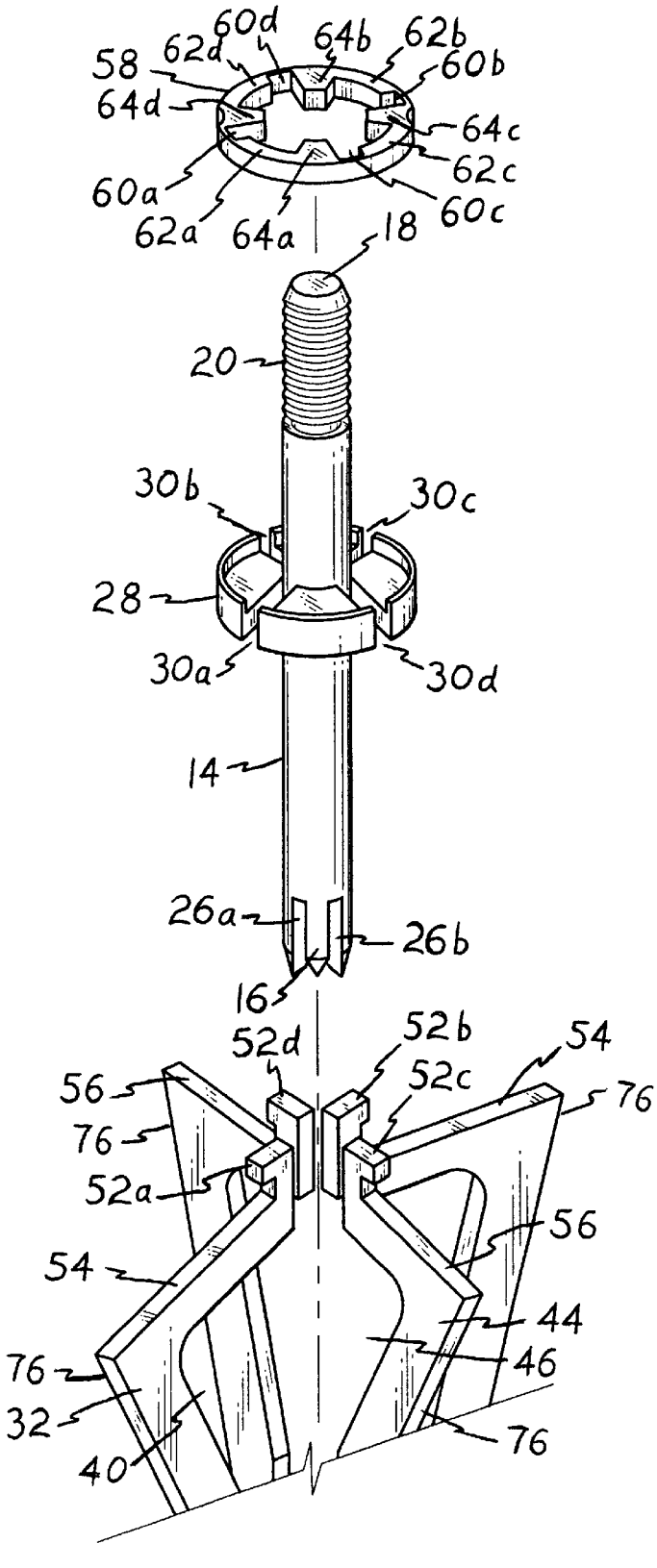
FIG. 6 is an exploded perspective view of the trailing end components of the arrowhead assembly, showing the withdrawal of the arrowhead body from the blades after removal of the lock washer.
Figure 7:
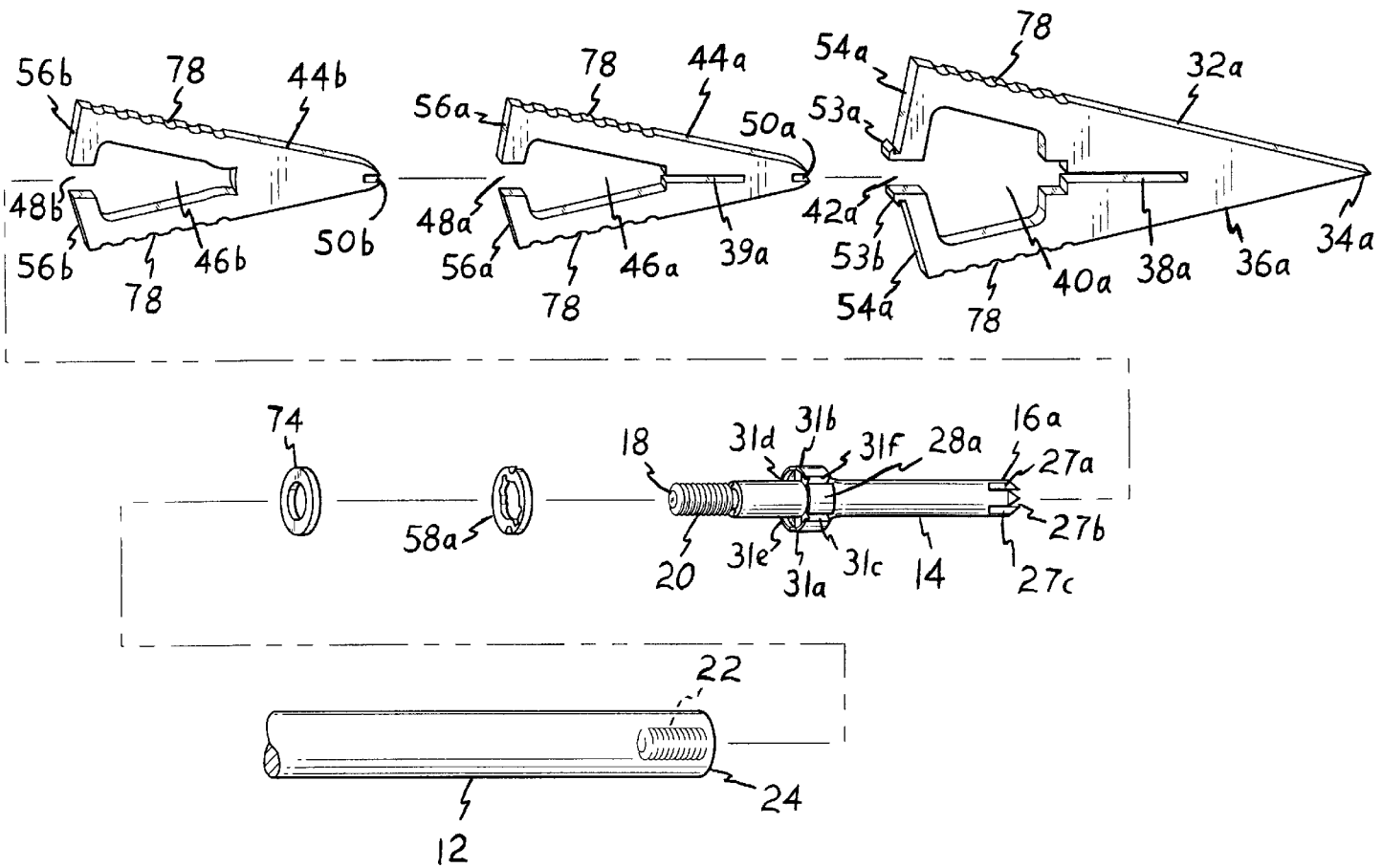
FIG. 7 is an exploded perspective view of an alternative embodiment of the present arrowhead assembly, having an arrowhead body slotted to accept a series of three separate blade elements and a series of three such blade elements having serrated edges.

FIGS. 5 and 6 provide the most detailed views of the lock washer 58. The locking washer 58 includes a series of internal, radially disposed blade tang clearance slots, which pass over the blade tangs when the washer 58 is placed thereover or removed therefrom. In the example of FIGS. 1 through 6, having two blade elements 32 and 44 with a series of four blade tangs 52*a* through 52*d*, a series of four blade tang clearance slots 60*a* through 60*d* is provided. It will be seen that additional slots may be provided for additional blade elements, if so required. Alternatively, the secondary blade(s) are not necessarily required to have such rearwardly disposed blade tangs, with the washer 58 merely bearing against their trailing ends and being held in place by the two blade tangs 52*a* and 52*b* of the primary blade element 32.

A similar series of internal, radially disposed blade tang catches, respectively 62*a* through 62*d*, is also provided within the washer 58. These catches pass in front of the blade tangs 52*a* through 52*d* of the assembly 10, between the tangs and the arrowhead retaining ring 28 positioned forwardly of the tangs and lock washer 58. Again, the number of blade tang catches depends upon the number of blade tangs of the assembly, with the number of catches being at least equal to the number of inwardly disposed slots of the washer and the number of blade tangs protruding rearwardly from the trailing edges of the blade elements. In addition, at least one (or more) inwardly disposed stop(s), e. g., stops 64*a* through 64*d*, is/are preferably provided, to preclude rotation of the lock washer 58 beyond the locking position when installed.

Figure 2:
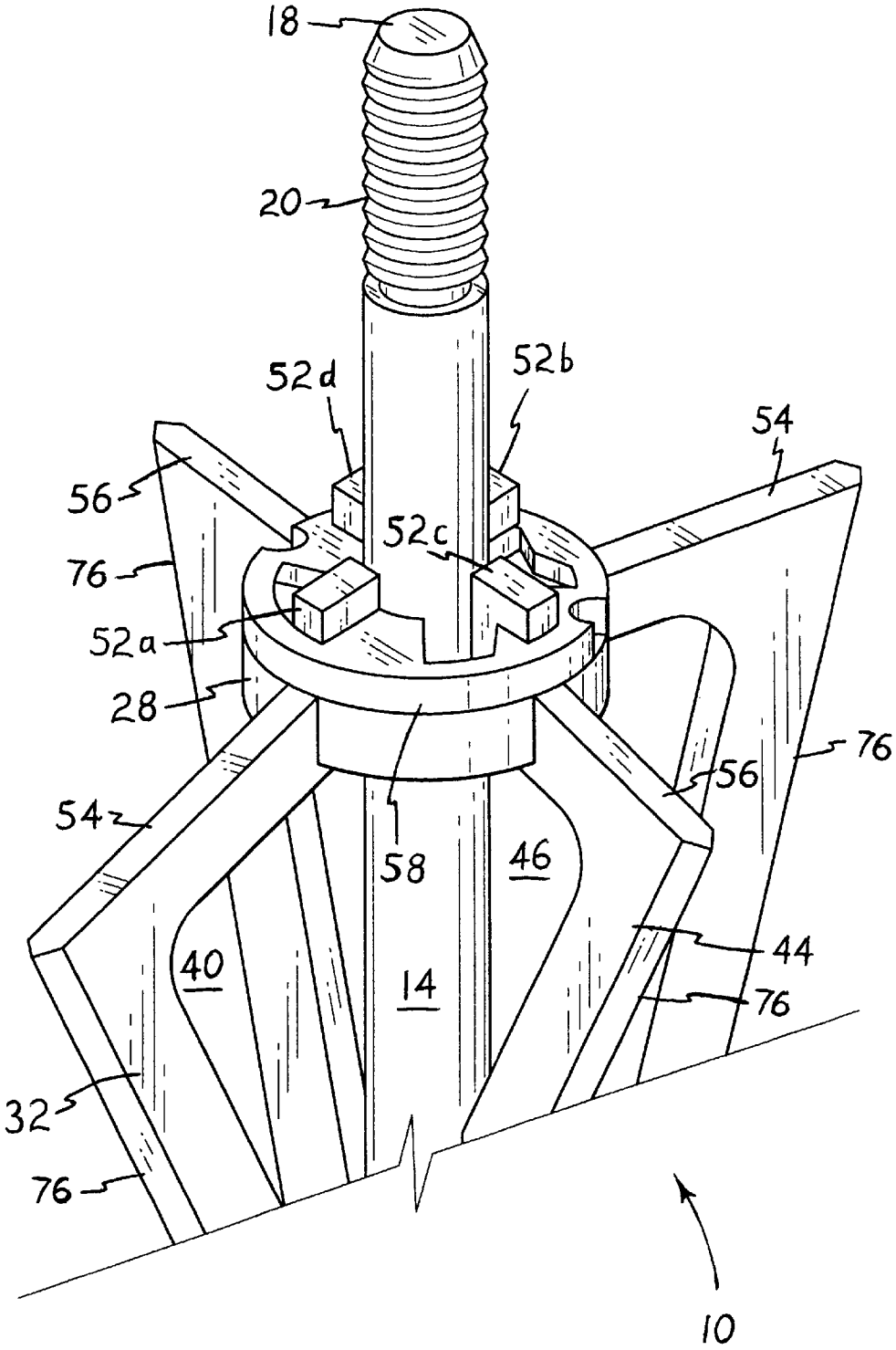
FIG. 2 is an enlarged, broken away perspective view of the trailing end of the present arrowhead assembly when assembled, showing details of the blade locking mechanism.

FIGS. 2 through 6 illustrate the steps involved in the disassembly of the present arrowhead assembly 10. In FIG. 2, the various components of the present arrowhead 10 are assembled, with the two blade elements 32 and 44 assembled in their cruciform configuration and installed on the arrowhead body 14. The four tangs 52*a* through 52*d* of the blade elements 32 and 44 extend rearwardly past the arrowhead retaining ring 28 of the body portion 14, with the lock washer or collar 58 installed between the tangs 52*a* through 52*d* and the retaining ring 28. The lock washer 58 has been turned to position the four blade tang catches 62*a* through 62*d* (shown in FIGS. 5 and 6) between their respective tangs 52*a* through 52*d* and the retaining ring 28, thus precluding forward motion of the blade elements 32 and 44 relative to the arrowhead body 14 to lock the blade elements 32 and 44 to the body 14.

Figure 3:
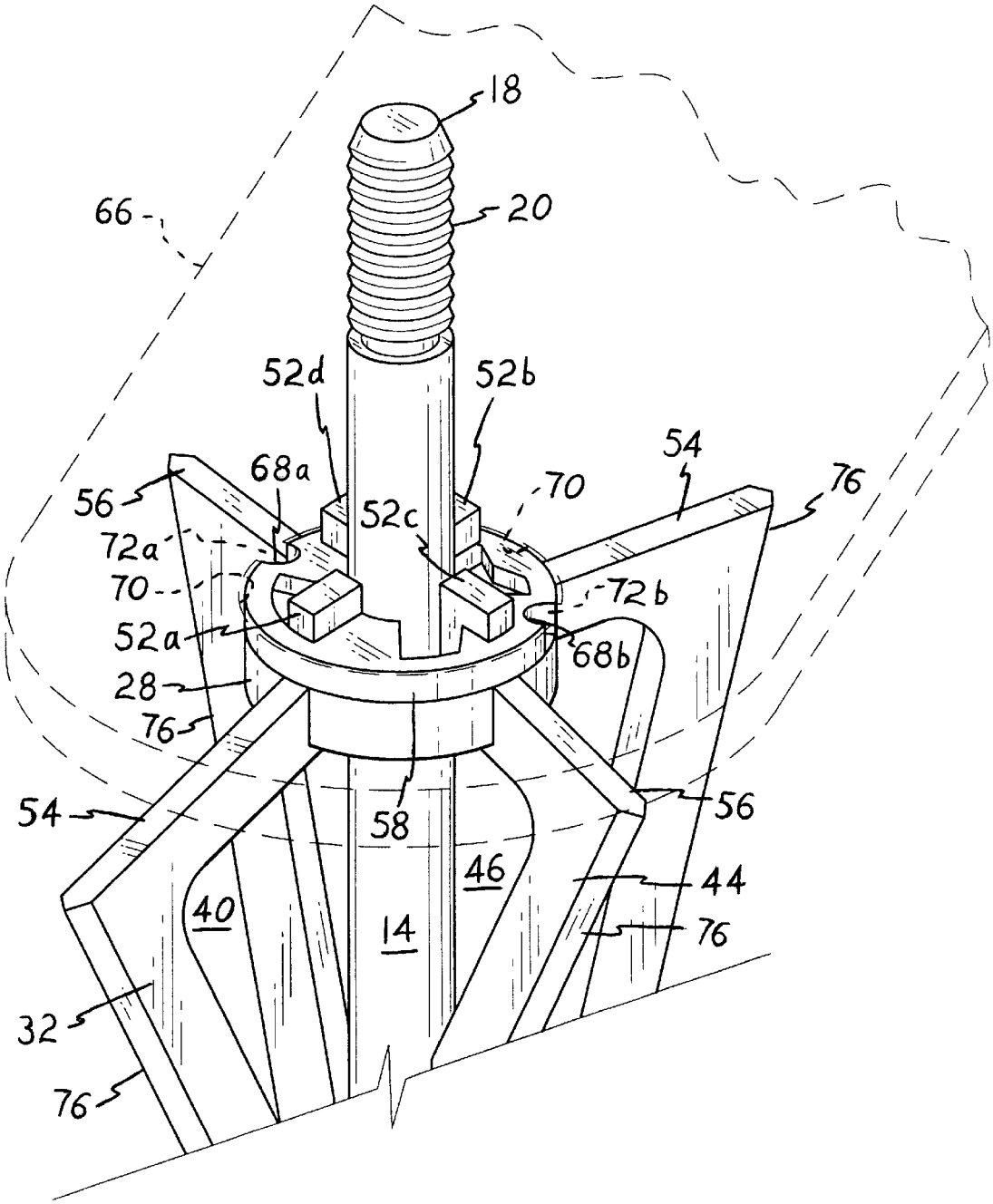
FIG. 3 is an enlarged, broken away perspective view essentially as shown in FIG. 2, but also showing the application of the lock washer installation and removal tool in broken lines.

FIG. 3 of the drawings is identical to FIG. 2 insofar as the arrowhead assembly 10 itself is concerned, but includes a lock washer removal and securing tool 66 positioned over or around the lock washer 58. The lock washer tool or wrench 66 is shown in broken lines, in order to provide clarity in the drawing Fig. for those arrowhead components shown thereunder in the drawing. The lock washer or collar 58 includes a pair of diametrically opposed indentations, respectively 68*a* and 68*b,* formed in the circumference thereof. The tool 66 includes a circular opening 70 closely fitting about the rim of the lock washer 58, with a pair of diametrically opposed protrusions, respectively 72*a* and 72*b,* which positively engage the two indentations 68*a,* 68*b* of the washer 58.

In FIG. 3, the tool or wrench 66 has been positioned across the lock washer 58, with the two opposed protrusions 72*a* and 72*b* engaging the corresponding indentations 68*a* and 68*b* of the lock washer 58. In FIG. 4, the wrench 66 remains engaged with the lock washer 58 as illustrated in FIG. 3 and described above, but the tool 66 has been turned counterclockwise to turn the four blade tang catches 62*a* through 62*d* (shown in FIG. 5) from their positions beneath the respective blade tangs 52*a* through 52*d,* aligning the four blade tang clearance slots 60*a* through 60*d* with the blade tangs 52*a* through 52*d.* The lock washer 58 need only be turned through about one twelfth of a revolution, as each blade tang catch 62*a* through 62*d* subtends an arc of only about thirty degrees.

The lock washer 58 may then be lifted clear of the arrowhead retaining ring 28 of the body portion 14, as shown in FIG. 5 of the drawings. At this point, there is no positive means holding the two blade elements 32 and 44 to the central arrowhead body 14 (although the machining tolerances are preferably quite close, in order to provide a tight fit for all components). Thus, the two blade elements 32 and 44 may be pulled forwardly from the retaining ring slots 30*a* through 30*d* of the retaining ring 28 on the arrowhead body 14, with the portions of the two arrowhead elements 32 and 44 engaging the slots 26*a* and 26*b* of the leading end 16 of the arrowhead body 14 being simultaneously withdrawn therefrom. The secondary blade element 44 may then be withdrawn from its engagement with the slot 38 of the primary blade 32, completing the disassembly for installation of a new blade, blade sharpening, etc.

The resulting separated components are illustrated in FIG. 1 of the drawings, with FIG. 1 also illustrating their relative positions for reassembly. Reassembly of the various components of the present arrowhead assembly is accomplished in the reverse order of the steps and illustrated in FIGS. 3 through 6 of the drawings and described above. The assembly may then be installed upon the conventional arrow shaft 12, by threading the externally threaded trailing end 18 of the arrowhead body 14 into the internally threaded leading end 24 of the arrow shaft 12, generally as shown in FIG. 1 of the drawings. A cap washer 74 may be removably installed between the leading end 24 of the arrow shaft 12 and the blade tangs 52*a* through 52*b* protruding rearwardly beyond the retaining ring 28, to protect the leading end 24 of the arrow shaft 12 from damage from the hard material of the blade elements 32 and 42 as the arrowhead body 14 is threaded into the arrow shaft 12.

FIG. 7 provides an exploded perspective view of alternate embodiments of the present invention, including an additional blade element with the blade elements having differently configured cutting edges. In FIG. 7, a series of three separate flat, planar knife blade elements, respectively 32*a,* 44*a,* and 44*b,* is shown. The first or primary blade element 32*a,* in the upper right in FIG. 7, has a general configuration essentially the same as that of the primary blade 32 illustrated in FIGS. 1 through 6, with a sharpened leading tip 34*a,* a solid forward portion 36*a* with an axial slot 38*a* formed therein, an open central portion 40*a* and open trailing end 42*a* between the two tangs 53*a* and 53*b* of the trailing end 54*a*.

The central secondary blade 44*a* has a configuration much like that of the secondary blade 44 of FIGS. 1 through 6, having an open center 46*a,* an open trailing end gap 48*a,* and a slot 50*a* formed in the leading tip thereof. However, the central secondary blade 44*a* differs from the secondary blade 44 of FIGS. 1 through 6, in certain respects. First, it includes an elongate axial slot 39*a* extending forwardly from the open central area 46*a,* to provide assembly with the trailing secondary blade 44*b*. Secondly, it will be noted that there are no locking tangs extending rearwardly from the trailing end 56*a* of the blade 44*a*. Tangs are only required for the first or primary blade 32*a,* depending upon the configuration of the locking washer, as will be explained further below.

Finally, a trailing secondary blade 44*b* includes a an open center 44*b,* an open trailing end gap 48*b,* and a slot 50*b* formed in the leading tip thereof. Again, no locking tangs are provided to extend rearwardly from the trailing end 56*b* of the trailing secondary blade 44*b*. These three blades 32*a,* 44*a,* and 44*b* are assembled by inserting the slotted tip 50*a* of the central secondary blade 44*a* into the slot 38*a* of the primary blade 32*a,* and inserting the slotted tip 50*b* of the trailing secondary blade 44*b* into the slot 39*a* of the central secondary blade 44*a*. It will be noted that while these three blades 32*a,* 44*a,* and 44*b* appear to be coplanar with one another in the two dimensional drawing of FIG. 7, the central slots 38*a* and 39*a* of the first two blades 32*a* and 44*a* allow the planes of those two blades, as well as the third blade 44*b,* to be turned relative to one another to define separate blade planes.

The three blades 32*a,* 44*a,* and 44*b* of FIG. 7 differ in another way from the blades 32 and 44 of FIGS. 1 through 6, in that those blades have straight cutting edges 76. In contrast, the blades 32*a,* 44*a,* and 44*b* have serrations 78 disposed along at least a portion of their cutting edges. It will be seen that the three blades illustrated in FIG. 7 may have straight edges, if so desired, and that the two blades 32 and 44 of FIGS. 1 through 6 may have serrations along a portion of or all of their edges, if so desired. Other blade edge configurations are also suitable for use with the present blade assembly, as the specific blade edge configurations do not impact upon the heart of the present invention, comprising the structure permitting assembly of the various blade components described herein.

An arrowhead body 14*a* is used to secure the three blades 32*a,* 44*a,* and 44*b* to the leading end 24 of an arrow shaft 12, just as in the example of FIGS. 1 through 6. The arrowhead body 14*a* of FIG. 7 differs from the arrowhead body 14 of FIGS. 1 through 6, in that the body 14*a* includes a series of three separate diametric slots, respectively 27*a,* 27*b,* and 27*c,* across the leading tip or end 16*a* of the body 14*a*. These slots 27*a* through 27*c* engage the back edges of the solid portions of the three arrowhead blades 32*a,* 44*a,* and 44*b,* to secure their forward portions on the arrowhead body 14*a,* in the manner of the arrowhead body 14, primary blade 32, and secondary blade 44 of FIGS. 1 through 6. The three slots 27*a* through 27*c* may be equally spaced angularly, i. e., 120 degrees apart, or may have irregular angular spacing, as desired.

In a similar manner, the arrowhead retaining ring 28*a* of the arrowhead body 14*a* is provided with a series of six slots 31*a* through 31*f,* for receiving the two trailing end edges of each of the three blades 32*a,* 44*a,* and 44*b.* These six slots are aligned with their respective leading tip slots 27*a* through 27*c,* and may be arcuately equally spaced at every sixty degrees about the circumference of the retaining ring 28*a,* or may have irregular angular spacing, so long as each two opposed slots are aligned with their corresponding diametric leading tip slot.

The lock washer 58*a* includes a single opposed pair of blade tang clearance slots, with each of those two clearance slots having a blade tang catch adjacent thereto. A further inwardly extending stop may be provided adjacent each of the two catches. These features are not shown in detail in FIG. 7, but a review of the detail of the lock washer 58 of FIGS. 5 and 6 will enable one skilled in the art to arrive at the simplified configuration of the lock washer 58*a* of FIG. 7.

Only a single pair of clearance slots, catches, and stops is required for the lock washer 58*a* of FIG. 7, as the two secondary blades 44*a,* 44*b* are not equipped with rearwardly extending tangs. Only the forward most primary blade 32*a* of the FIG. 7 embodiment includes a pair of such tangs 53*a,* 53*b.* Thus, while the trailing ends 56*a,* 56*b* of the two secondary blades 44*a,* 44*b* engage their respective slots 31*c* through 31*f* in the retaining ring 28*a,* they have no tangs to engage the lock washer 58*a,* thus requiring only a pair of clearance slots, catches, and stops for the washer 58*a.*

In conclusion, the present arrowhead assembly provides a structure which greatly facilitates the assembly and disassembly of the apparatus for arrowhead blade replacement, sharpening, and/or other purposes as desired. The non-threaded lock washer enables an archer to remove and replace the washer quickly, requiring only a small fraction of a revolution of the washer to unlock the blade tangs from the retaining ring of the arrowhead body. This greatly facilitates blade replacement in the field, enabling the archer to repair a damaged arrowhead much more rapidly than is possible with threaded components. The present blade assembly holds all blade and body components together as securely as the attachment which is available with prior art threaded components, assuring that the blades maintain their axial alignment for an accurate flight path through the air and further assuring that they cannot become separated from the arrowhead body upon launch, in flight, or upon impact with the target. The present arrowhead assembly is adaptable to any practicable number of blade elements, from a single primary blade to a primary blade and one or more secondary blades, depending upon the configuration of the arrowhead body and the number of blade slots provided therein. Accordingly, the versatility and ease of use and maintenance of the present arrowhead assembly will prove to be of great value to all who enjoy the sport of archery.

It is to be understood that the present invention is not limited to the embodiments described above, but encompasses any and all embodiments within the scope of the following claims.

I claim:

1. An arrowhead assembly comprising:

an elongate arrowhead body having a leading end and a trailing end opposite said leading end, said leading end having at least one arrowhead retaining slot formed diametrically across said arrowhead body;

an arrowhead blade retaining ring disposed circumferentially and concentrically around said arrowhead body, between said leading end and said trailing end thereof, said ring having a plurality of arrowhead retaining slots disposed radially about said ring;

at least one flat, planar, laterally symmetrical arrowhead blade having an open center and trailing end for clearance about said arrowhead body when assembled thereto, said trailing end having two mutually opposed locking tangs extending rearwardly and outwardly from said trailing end of said at least one arrowhead blade, said locking tangs of said at least one arrowhead blade extending rearwardly beyond said arrowhead blade retaining ring of said arrowhead body, when said at least one arrowhead blade is assembled with said arrowhead body; and a lock washer having at least two inwardly disposed blade tang clearance slots and at least two inwardly disposed blade catches formed therein;

wherein said blade catches of said lock washer extend between said arrowhead blade retaining ring of said arrowhead body and said locking tangs of said at least one arrowhead blade, and removably secure said at least one blade to said arrowhead body when said lock washer is selectively installed upon said arrowhead body.

2. The arrowhead assembly according to claim 1, wherein said at least one arrowhead blade comprises:

a single primary arrowhead blade having a pointed leading tip and an axially disposed internal slot; and at least one secondary arrowhead blade having a slotted leading tip, the slotted leading tip of said secondary blade engaging the internal slot of said primary arrowhead blade for concentric assembly therewith.

3. The arrowhead assembly according to claim 1, wherein said at least one arrowhead blade is selected from the group consisting of arrowhead blades having straight sharpened edges and arrowhead blades having serrated sharpened edges.

4. The arrowhead assembly according to claim 1, further including an arrow shaft having an internally threaded leading end.

5. The arrowhead assembly according to claim 4, wherein the trailing end of said arrowhead body is externally threaded for removable threaded engagement with the internally threaded leading end of said arrow shaft.

6. The arrowhead assembly according to claim 1, further including a cap washer removably disposed between said arrowhead retaining ring and said trailing end of said arrowhead body.

7. The arrowhead assembly according to claim 1, further including:

a lock washer removal and securing tool;

said tool further including means for positively engaging said lock washer; and said lock washer further including means for engaging said positive lock washer engaging means of said tool.

8. An arrowhead assembly comprising:

an elongate arrowhead body having a leading end and a trailing end opposite said leading end, the leading end having a plurality of arrowhead retaining slots formed diametrically across said arrowhead body;

an arrowhead blade retaining ring disposed circumferentially and concentrically with said arrowhead body, between the leading end and the trailing end, the ring having a plurality of arrowhead retaining slots disposed radially about the ring;

a single flat, planar, laterally symmetrical primary arrowhead blade having a pointed leading tip and an axially disposed internal slot;

at least one flat, planar, laterally symmetrical secondary arrowhead blade having a slotted leading tip for engaging the internal slot of said primary arrowhead blade for concentric assembly therewith, said primary and said at least one secondary arrowhead blade each having an open center and trailing end for clearance about said arrowhead body when assembled thereto;

two mutually opposed locking tangs extending rearwardly and outwardly from the trailing end of at least said primary arrowhead blade, said locking tangs extending rearwardly beyond said arrowhead blade retaining ring of said arrowhead body, when each said arrowhead blade is assembled with said arrowhead body; and a lock washer having at least two inwardly disposed blade tang clearance slots and at least two inwardly disposed blade catches formed in said lock washer;

wherein the blade catches of said lock washer extend between said arrowhead blade retaining ring of said arrowhead body and said locking tangs of at least said primary arrowhead blade, and removably secure each said arrowhead blade to said arrowhead body when said lock washer is selectively installed upon said arrowhead body.

9. The arrowhead assembly according to claim 8, wherein each said arrowhead blade is selected from the group consisting of arrowhead blades having straight sharpened edges and arrowhead blades having serrated sharpened edges.

10. The arrowhead assembly according to claim 8, further including an arrow shaft having an internally threaded leading end.

11. The arrowhead assembly according to claim 10, wherein the trailing end of said arrowhead body is externally threaded for removably threaded engagement with the internally threaded leading end of said arrow shaft.

12. The arrowhead assembly according to claim 8, further including a cap washer removably disposed between said arrowhead retaining ring and said trailing end of said arrowhead body.

13. The arrowhead assembly according to claim 8, further including:

a lock washer removal and securing tool;

said tool further including means for positively engaging said lock washer; and said lock washer further including means for engaging said positive lock washer engaging means of said tool.

14. An arrow comprising:

an arrow shaft having an internally threaded leading end;

an elongate arrowhead body having a leading end and a trailing end opposite said leading end, the trailing end of said arrowhead body having external threads disposed thereon and cooperating with the internally threaded leading end of said arrow shaft, for removable threaded engagement therewith, the leading end of said arrowhead body having at least one arrowhead retaining slot formed diametrically across said arrowhead body;

an arrowhead blade retaining ring disposed circumferentially and concentrically with said arrowhead body, between the leading end and the trailing end thereof, the ring having a plurality of arrowhead retaining slots disposed radially about the ring; and at least one flat, planar, laterally symmetrical arrowhead blade having an open center and trailing end for clearance about said arrowhead body when assembled thereto and having two mutually opposed locking tangs extending rearwardly and outwardly from the trailing end of said at least one arrowhead blade, said locking tangs of said at least one arrowhead blade extending rearwardly beyond said arrowhead blade retaining ring of said arrowhead body when said at least one arrowhead blade is assembled with said arrowhead body; and a lock washer having at least two inwardly disposed blade tang clearance slots and at least two inwardly disposed blade catches formed therein;

wherein said blade catches of said lock washer extend between said arrowhead blade retaining ring of said arrowhead body and said locking tangs of said at least one arrowhead blade, and removably secure said at least one blade to said arrowhead body when said lock washer is selectively installed upon said arrowhead body.

15. The arrow according to claim 14, wherein said at least one arrowhead blade comprises:

a single primary arrowhead blade having a pointed leading tip and an axially disposed internal slot; and at least one secondary arrowhead blade having a slotted leading tip, for engaging the internal slot of said primary arrowhead blade for concentric assembly therewith.

16. The arrow according to claim 14, wherein said at least one arrowhead blade is selected from the group consisting of arrowhead blades having straight sharpened edges and arrowhead blades having serrated sharpened edges.

17. The arrow according to claim 14, further including a cap washer removably disposed between said arrowhead retaining ring and the trailing end of said arrowhead body.

18. The arrow according to claim 14, further including:

a lock washer removal and securing tool;

said tool further including means for positively engaging said lock washer; and said lock washer further including means for engaging said positive lock washer engaging means of said tool.

* * * * *